United States Patent [19]

Giler

[11] 4,417,346

[45] Nov. 22, 1983

[54] HIGH TEMPERATURE MELTING FURNACE

[75] Inventor: Roger R. Giler, Wilton, Conn.

[73] Assignee: The Kanthal Corporation, Bethel, Conn.

[21] Appl. No.: 278,053

[22] Filed: Jun. 29, 1981

[51] Int. Cl.[3] ..... H05B 3/00; F27D 1/00

[52] U.S. Cl. ..... 373/137; 373/130; 373/132

[58] Field of Search ..... 373/111, 115, 130, 132, 373/133, 137; 219/343, 390; 432/238

[56] References Cited

U.S. PATENT DOCUMENTS 2,966,537 12/1960 Witucki et al. ..... 373/132 X 3,786,162 1/1974 Colson .

4,266,119 5/1981 Best ..... 373/125

OTHER PUBLICATIONS

Brochure-Evenheat Kiln, Inc.; Caseville, Mich.

*Primary Examiner*—Roy N. Envall, Jr.

*Attorney, Agent, or Firm*—Kenyon & Kenyon

[57] ABSTRACT

A high temperature melting furnace including a fibrous refractory cylindrical shell with a fibrous refractory top and a bottom composed of similar material. Heating is provided by molybdenum disilicide resistance wire loops hanging inside the shell. The furnace top has a removable closure plug for access to the furnace when in operation and the furnace bottom has a verticle charging hole with a removable pedestal insertable therein.

5 Claims, 6 Drawing Figures

HIGH TEMPERATURE MELTING FURNACE

BACKGROUND OF THE INVENTION

Research and development in the field of metals, slags and the like conventionally involve the use of bulky, expensive and relatively unsophisticated melting equipment.

In laboratories, melting furnaces are used which are small only as compared to full scale industrial furnaces. They must be permanently installed and normally comprise a steel shell lined with substantially the same refractory used by the industrial furnaces.

Using such a refractory lining and with furnace temperatures the same or possibly higher than those of many industrial furnaces, the furnace linings of laboratory furnaces must be made with the lining thicknesses of the industrial furnace linings, to maintain the outside of the furnace at tolerable temperatures for the operating technicians.

A small portable furnace unit which can be used to melt only a few hundred grams of material under precisely controlled conditions, with a finger-touchable outside surface temperature, is an attractive concept in connection with improving the technology of experimenting and developing high temperature melting materials. The development of such a small furnace unit has been inhibited by the prior art concepts concerning melting furnace constructions.

SUMMARY OF THE INVENTION

The present invention has resulted in the provision of such a furnace unit and which is now in commercial production.

Miniaturization of this unit's furnace per se is effected by making the furnace in the form of a vertical tubular shell resting on a flat furnace bottom with a flat furnace top resting on the shell's top, the three parts being each made of a relatively fragile but self-supporting fibrous material comprising interlocked refractory ceramic fibers compacted to a density providing the material with an optimization of low heat conductivity and low radiation transmission. Using these basic components, it has been ppossible to make the shell, which functions as a furnace wall, and receives the greatest furnace heat, with an inside diameter of 4", an outside diameter of 8", giving only a 2" wall thickness, and which when internally heated to temperatures as high as 3,000° F., has an outside temperature so low that the furnace can be encased by a sheet metal casing to form a portable unit, with the casing walls spaced from the furnace wall only about one inch and having a low enough temperature to permit manual finger touching without discomfort when the furnace is operating and the casing is only fan-cooled. The furnace top and furnace bottom of the commercial unit's furnace are made with a thinner wall thickness ranging from 1" to a little less than 2". The dimensions stated are to be taken as exemplary only.

The material described is commercially available and is made in various forms by the vacuum forming technique. In this a slurry of the ceramic fibers, possibly with an inorganic binding medium, is sucked against a screen shaped to provide the desired contour, the fibers packing against the screen so that with drying a permanent shape of interlocked fibers is obtained. The fibers are a ceramic having an adequately high melting temperature, at least 3000° in the case of the three basic components. Depending on the vacuum forming technique, the density of the material can be adjusted to that desired. When of low density, the material has low heat conductivity but high heat radiation transmission at the furnace temperatures. In other words, when of low density it is semitransparent to high temperature radiation. As the density is increased, the radiation transmission is decreased, but the material's heat conductivity increases. Consequently, there is a density which provides a balance between the radiation and conductivity losses to be expected and for the three basic components these can be optimized to provide the lowest practical overall heat loss at the operation temperature range of the furnace.

In the present case the fibrous material shell alone structurally supports the furnace top and the weight of electric resistance heating elements suspended inside of the shell. The material is fragile and easily broken by mechanical stress.

The above disadvantage is overcome by a design wherein the furnace parts are simply stacked one on top of another so that the parts are held together essentially gravitationally and are free to expand or contract without being mechanically stressed so as to break.

BRIEF DESCRIPTION OF THE DRAWINGS

The accompanying drawings show the commercial unit and are for use in connection with the following detailed description, the various views being as follows.

DETAILED DESCRIPTION OF THE INVENTION

Because this illustrated furnace is the commercial design of this invention, reference has been and will be made to the specific dimensions involved to emphasize the compactness of the furnace but with the understanding that the invention is not limited to these dimensions.

Figure 2:
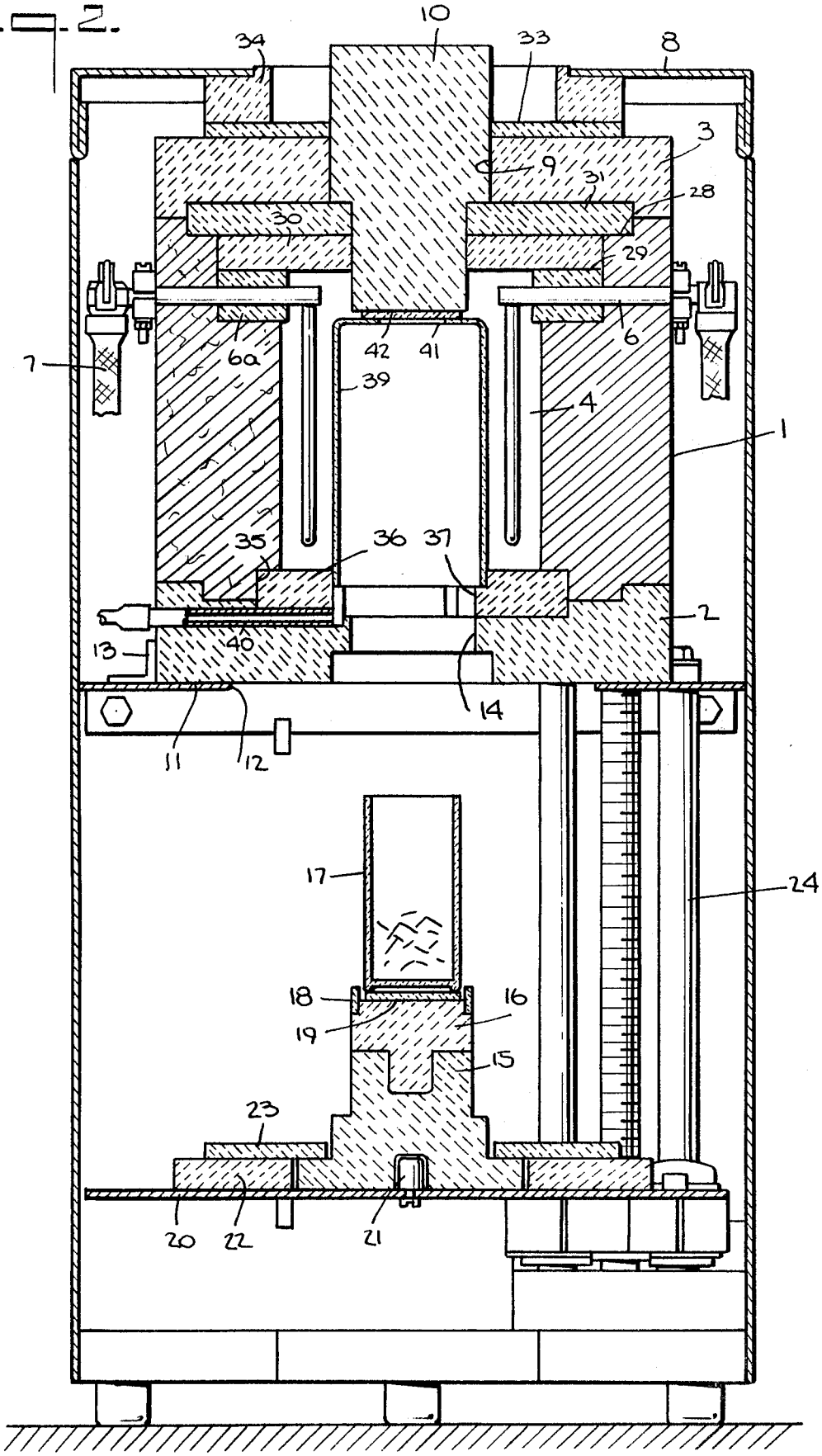
FIG. 2 is a vertical section taken on the line II—II in FIG. 1 and shows the furnace with a charged crucible ready for insertion in the furnace.
Figure 3:
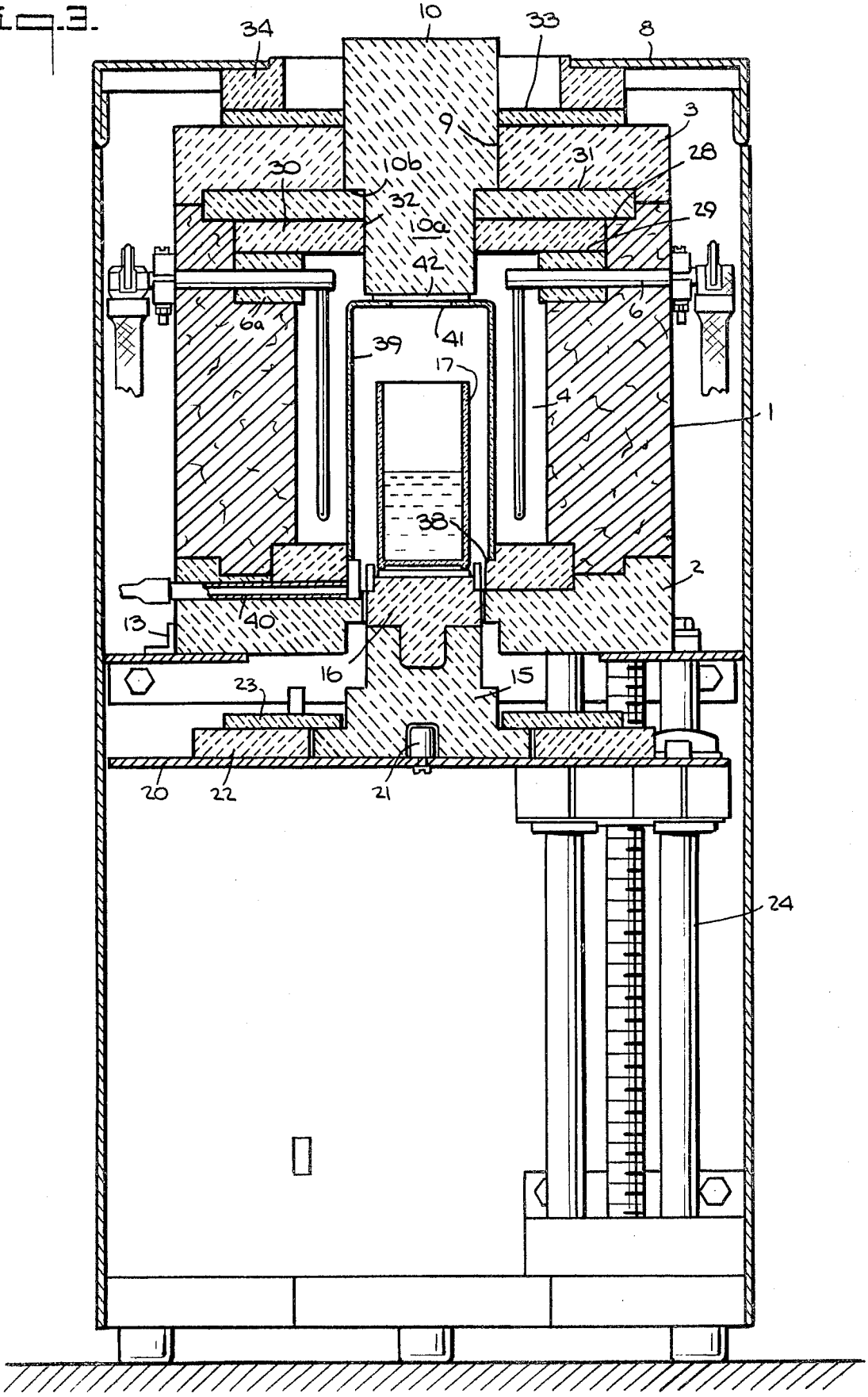
FIG. 3 is the same as FIG. 2 but shows the crucible entering the furnace.
Figure 4:
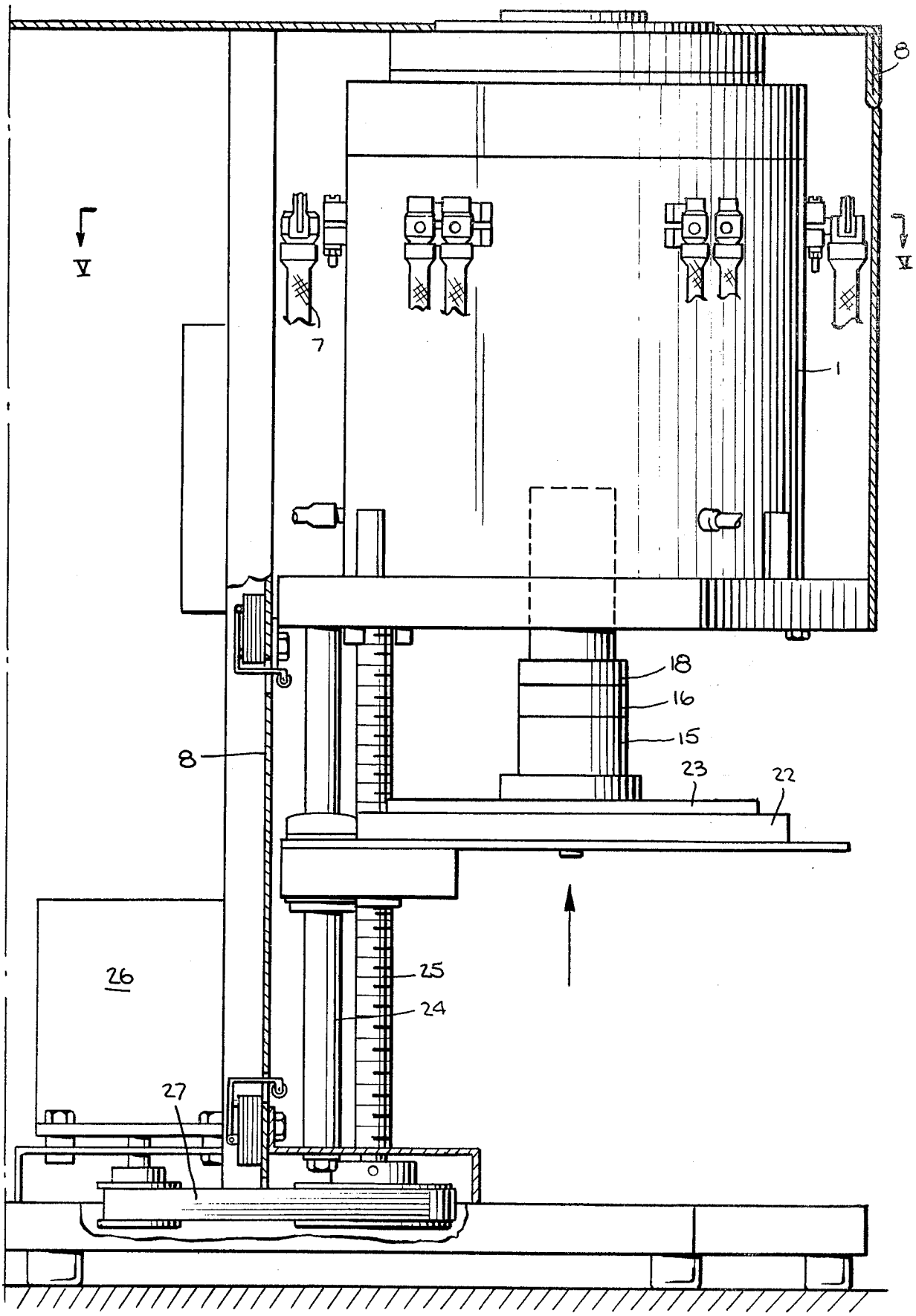
FIG. 4 is a side elevation view of the furnace looking to the right in FIG. 1 with part of the casing eliminated.
Figure 5:
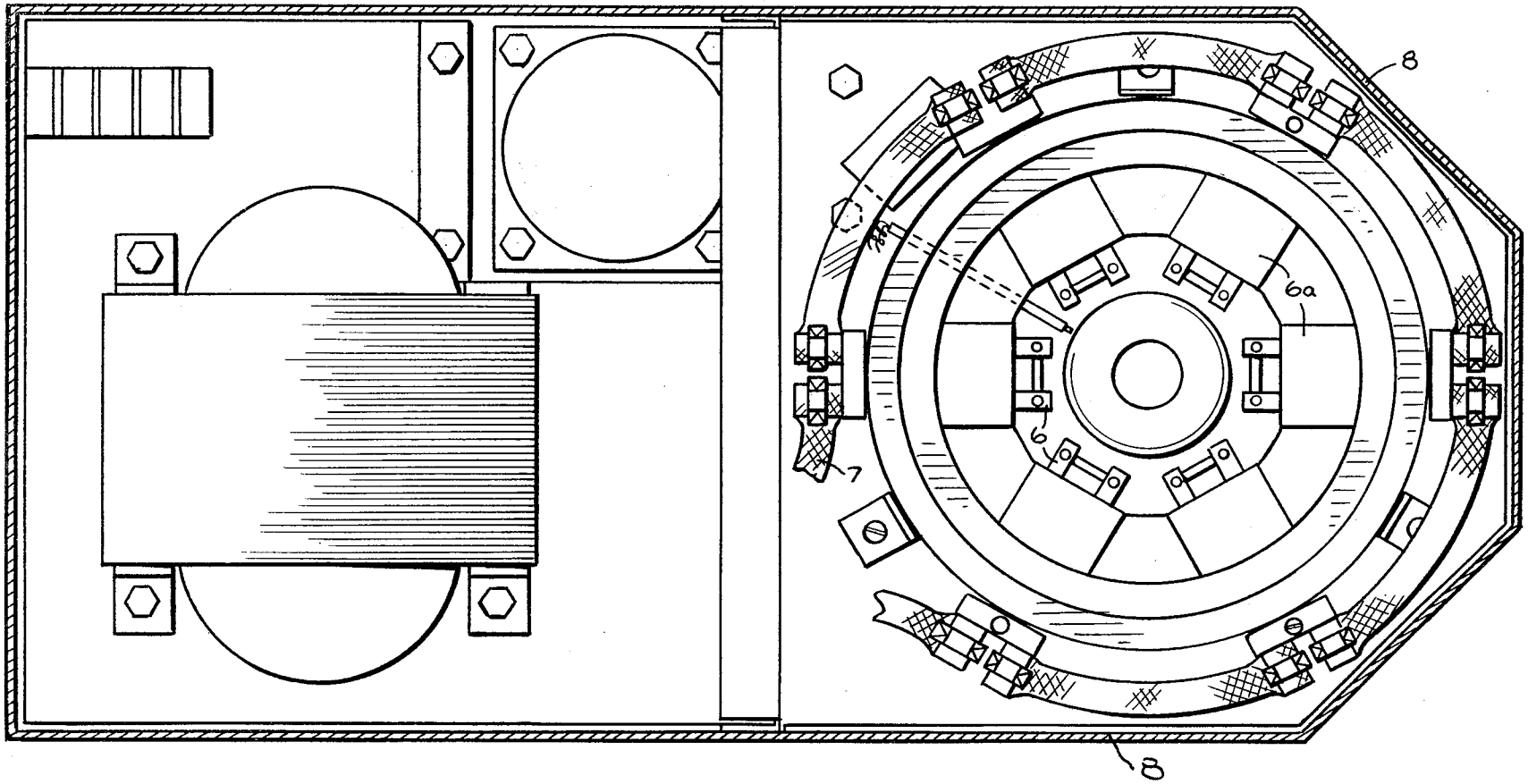
FIG. 5 is a horizontal cross section taken on the line V—V in FIG. 4.
Figure 6:
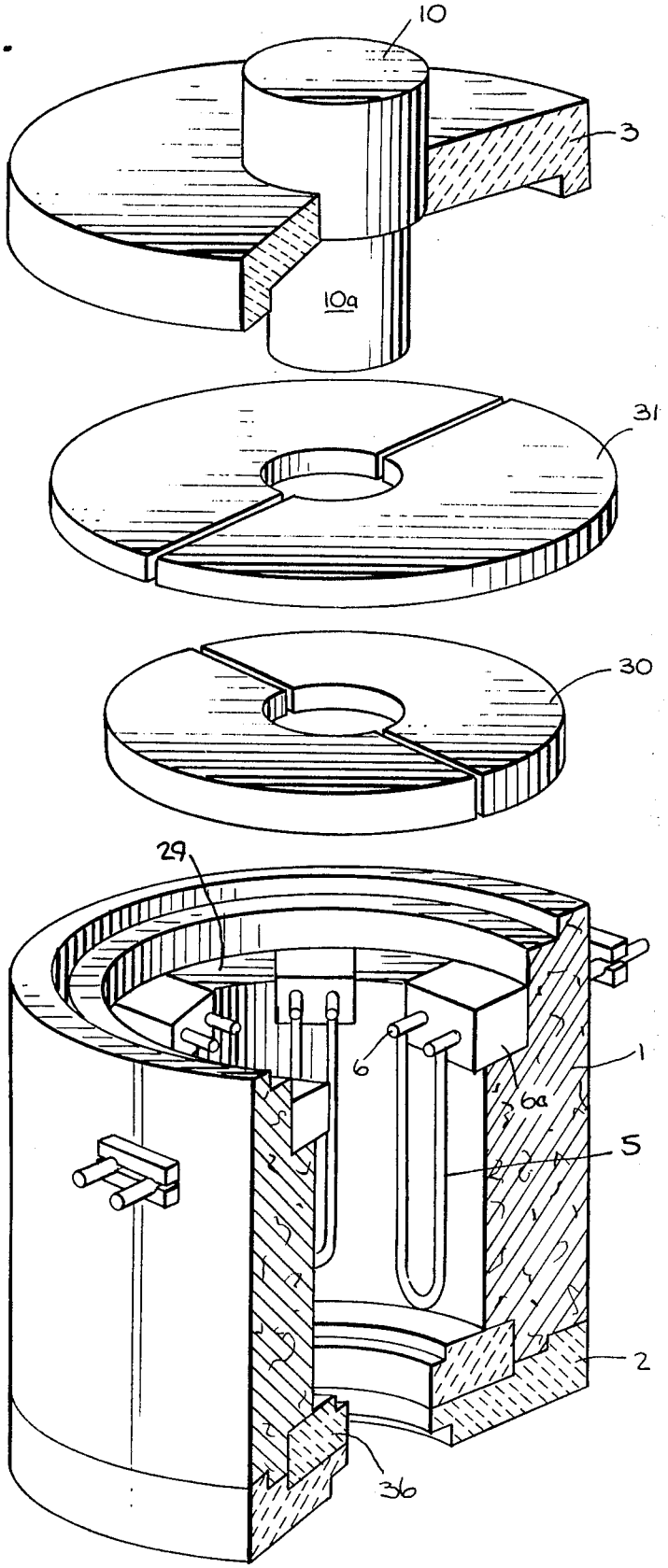
FIG. 6 is an exploded perspective view showing the salient furnace parts.

In FIGS. 2, 3 and 6, the furnace shell 1 is shown as being a vertical cylinder 6" high with the 4" inside diameter, 8" outside diameter, and 2" wall thickness previously mentioned. It is made of the described fragile fibrous material comprising interlocked refractory ceramic fibers compacted to a density providing the material with the optimized combination of low heat conductivity and low heat radiation transmission. The circular furnace bottom 2 is made of the same material and the shell bottom rests on this furnace bottom, their intercontacting surfaces being shaped to prevent radial displacement. The circular furnace top 3, also made of the same material, rests on the shell top. In this way a heating space 4 is formed inside of the shell between its top and bottom.

High temperature heating means inside of the shell comprise a series of six of the molybdenum disilicide heating elements disclosed by the Best U.S. Pat. No.

4,266,119. These elements are shown in perspective by FIG. 6 wherein the molybdenum disilicide hairpin electric resistance loops 5 depend from the unique right angle molybdenum disilicide terminals 6 extending through the fibrous material wall of the shell 1 to the latter's outside where they are electrically connected by clamps to electric power lines 7. The hairpin loops each have a length of 4¾" and a wire diameter of 3 mm and can operate at temperatures up to above 3,200° F. These elements are spaced from the inside of the shell 1 and form a series conforming to the inside shape of the shell 1. Their terminals are supported by the shell via element plugs 6*a* made of a higher density and, therefore, stronger refractory fibrous material. The plugs are inset in notches formed in the shell top and spaced inwardly from the shell's outside with a substantial amount of the shell's material preventing heat loss from the plugs. The plugs 6*a* prevent concentrations of the terminal weight on the fragile shell. The terminals are cemented in the backs of the plugs so as to seal against radiant heat loss.

The furnace is encased by a steel casing 8 which compactly encloses the outside of the furnace with an intervening air space of only about 1" or possibly slightly less. A small fan (not shown) blows air through this space. With the shell wall made of the described material and with the molybdenum disilicide elements operating at a temperature of 3,270° F., the thermal insulating value of the 2" thick shell wall is so great that the outside of this steel casing can be finger-touched without discomfort. For corresponding thermal insulation effect, industrial furnaces have linings of a foot or more thickness.

The furnace top 3 is formed with an access hole 9 which gives access to the heating space 4 downwardly in a vertical direction, and a closure plug 10, made of the same material as the shell, is removably inserted in this hole 9. Because of the great insulating property of this material, the top of this plug which projects upwardly above the furnace top 3 and through and above a hole in the steel casing 8, can be manually picked up by its top when plug removal is desired to give access to the furnace's inside. The total length of this plug is 4".

The furnace is mounted inside of the casing 8 on a stationary sheet metal tray 11 having a bottom hole 12 on which the furnace gravitationally rests, it being held in alignment with the hole 12 by means of a series of upstanding softly padded metal lugs 13. The furnace bottom 2 is formed with a charging hole 14 and a pedestal 15 made of the described shell material is removably insertable in this hole and has a pedestal top 16 made of higher-density fibrous material, but with the fibers having the 3000° F. melting temperature, this top being adapted to support a small refractory crucible 17. The pedestal top has a crucible-centering and pedestal-top reinforcing ring 18 and is covered by a disk 19, both of these parts being made of alumina. The disk 19 protects the fibrous material of the pedestal 15 against possibly sticking to the crucible bottom. This pedestal rests on a sheet steel elevator tray 20 where it is centered in alignment with the charging hole 14 by a metal pin 21. The pedestal 15 is surrounded by a refractory fibrous base plate 22 in the form of a ring on top of which an annular seal ring 23 rests and which is made of relative soft fibrous refractory material. The ring 13 is made of fibrous refractory of a density higher than that of the shell material.

This horizontal elevator tray 20 is vertically movably supported by two guide rods 24 which are horizontally offset from the charging hole 14 and the pedestal 15 and the crucible 17 supported by this pedestal. The elevator is moved up and down by a screw 25 powered by an electric motor 26 via a belt drive 27. Precision design of these parts results in a slow and very steady movement of the elevator tray so as not to risk upsetting the crucible 17 on the pedestal top 16 of the pedestal carried by the elevator tray. Such precision construction is expensive and therefore the screw and guide bars are horizontally offset far enough from below the furnace's charging hole 14 and the pedestal travel to reduce risk of damage to these elevator parts in the event the crucible 17 breaks and spills its molten content. Such breakage is potential even though the crucible 17 is made of alumina and is of small size, being only 3" high and 1½" in diameter to provide a total volume of only 4.5 cubic inches.

Figure 1:
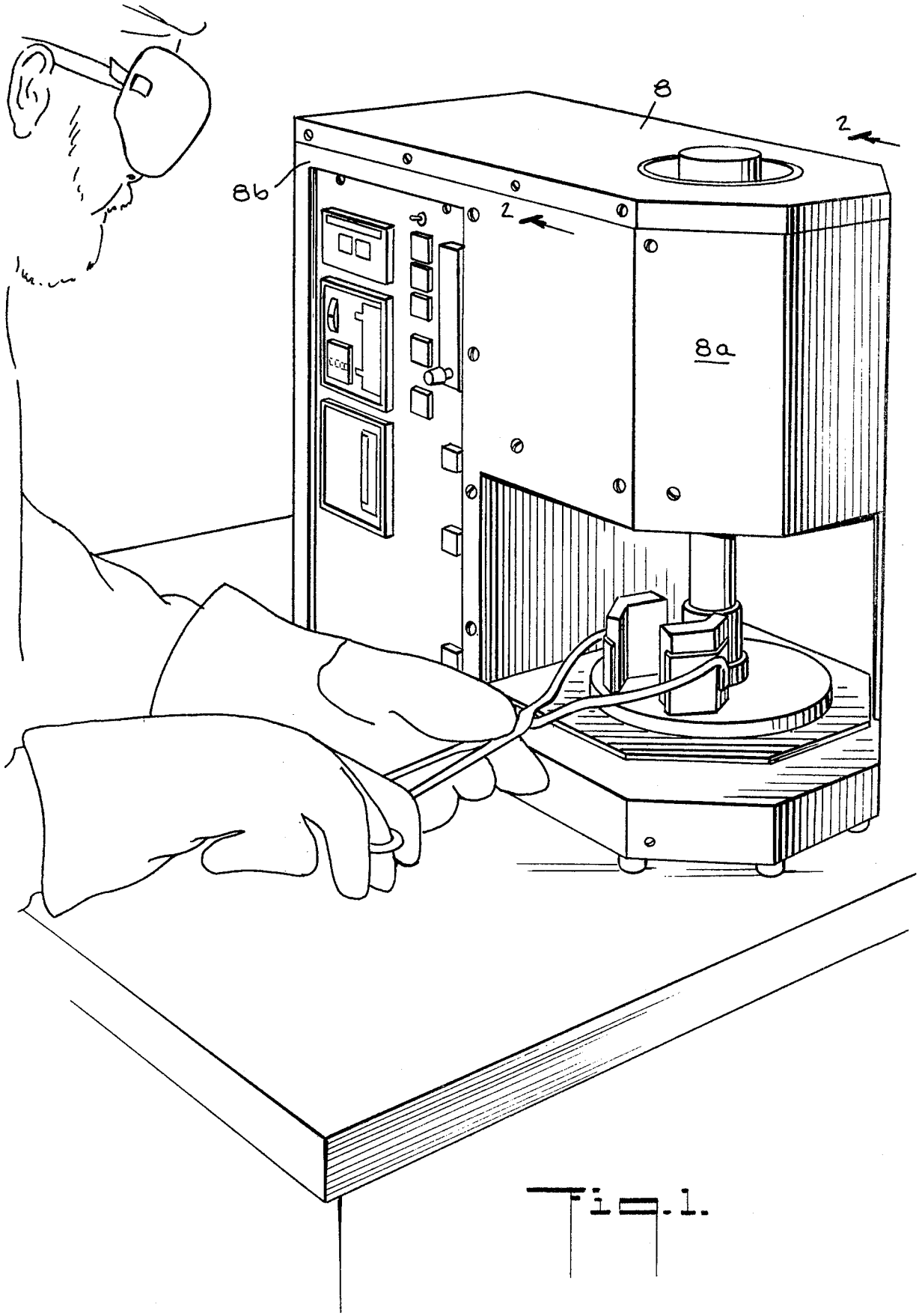
FIG. 1 is a perspective view of the furnace unit in operation.

This elevator tray moves the pedestal 15 between a down position as shown in FIGS. 1 and 2 where the crucible 17 can be positioned on or removed from the pedestal top and an up position, shown approaching by FIG. 3, where the crucible is carried by the pedestal via the elevator tray upwardly into the heating space 4. The pedestal is designed to close the charging hole 14 when in its up position.

The shell top is formed with internal recessed upper and lower annular shelves 28 and 29 respectively of larger and smaller diameters. A small disk 30 rests on the lower shelf and a larger disk 31 rests on the upper shelf and in the larger hole. Both disks cooperatively form a shank hole 32 of smaller diameter than the access hole 9 formed in the furnace top and the closure plug 10 has a shank 10*a* of reduced diameter which slidably fits in the shank hole 32, the plug forming a shoulder 10*b* resting on the large disk 31. Both disks are made of a fibrous refractory of greater density and greater strength than the fibrous material from which the shell and its top and bottom are made. These disks hold the plug 10 against inadvertent horizontally applied force which might damage the fragile plug and the equally fragile furnace top 3 having the hole in which the plug is inserted and removed. In addition, the disks support the fragile furnace top above the heating space 4 with the weight of all of the upper parts distributed into the shell via the two annular shoulders 28 and 29.

A seal 33 is positioned on the top surface of the furnace top 3 and is held down by a spacer ring 34 having an upstanding flange fitting in a hole in the steel casing wall above the furnace. The spacer ring is made of substantially the same fibrous material as the shell. To hold together, without applying rigid pressure, the stack of furnace parts, the seal 33 is a soft resilient blanket of refractory fibers.

The high furnace temperatures may cause thermal changes in the two disk rings 30 and 31. Therefore, these parts are made as a plurality of parts as illustrated by FIG. 6, which fit together so that there are radial slits between them. These two parts are placed on their respective annular shelves so that their slits are oriented at an angle with respect to each other, which is a 90° angle when each disk is made of two parts. This accommodates thermal expansion or possible shrinkage on the part of the two ring disks which are made of the higher density stronger material.

The shell bottom forms an internal recessed annular shoulder 35 around the charging hole 14 and an annular muffle support disk 36 made of the stronger fibrous material of greater density rests on this shoulder. This support disk forms a passage 37 for the pedestal 15, and has an internal annular support shoulder 38 on which an inverted cup-like refractory alumina muffle 39 rests. The pedestal and its pedestal top are insertable through this pedestal passage 37, via the charging hole 14, so as to carry the crucible 17 on the pedestal top into the muffle. A gas tube 40 extends radially through the furnace bottom 2 so as to communicate with the inside of the muffle 39. In this way the muffle can be flushed with a gas providing any desired atmosphere in the muffle 39 and which surrounds the crucible and its contents. For access to the crucible, the top wall of the muffle is formed with an access hole 41 which can be closed by a removable alumina disk 42 when ae gaseous muffle atmosphere is desired. Otherwise, this disk 42 is not used and access to the crucible is possible.

Looking at FIG. 1, this new furnace unit has its sheet steel casing 8 completely enclosing the furnace by its upper right-hand portion 8*a*, and a left-hand portion 8*b* housing any and all furnace temperature indicating and control units considered necessary and which may be designed to suit, therefore not being illustrated in detail. The commercially produced furnace is only 20¾" high, 22" wide and 11¾" deep, and it weighs only 113 lbs. It can be operated via standard 230 V 15a electric power output and as previously indicated, at operating temperatures extending up to 3000° F. With the heating elements described and a charged crucible inside of the muffle, this little furnace can be brought up to this temperature in only 8 minutes with the crucible temperature lagging by only a minutes or so. At the termination of the melting period, when the furnace heating power is turned off, the furnace cools less fast. During operation, the exterior of the shell 1 which receives the maximum possible internal heat, does become warm and, therefore, in the commercial unit a fan (not shown) is installed in the casing section 8*b* both to keep the casing section 8*a* cooler and to protect the instrumentation in the section 8*b*.

As shown by FIG. 1, the casing is open for 180° around the elevator tray which is supported in the form of a cantilever. The furnace is elevated and there is plenty of working space below. A cold crucible with a cold charge can be placed on the pedestal by hand and the elevator then raised, power applied to the resistance heating elements starting the melt. If the muffle is gassed, the disk 42 remains in place if a pure gas atmosphere is desired. It is not used if melt additions are desired, for which the plug 10 is lifted out to permit access to the crucible melt. After processing of the melt, the elevator tray is made to quickly descend and the crucible and its melt can be removed, using a suitable tool as indicated in FIG. 1.

The furnace parts used at the highest temperature locations are made of alumina fibers but the parts used at lower temperature locations can be made of alumina silicate fibers. In general, the design of this new furnace makes possible the use of the fibrous materials providing the maximum heat insulation but which has heretofore been considered to be unsuitaable for structural parts.

For example, the furnace bottom 2 made of the very fragile material must carry the weight of the muffle 39, but the stress is distributed by the stronger muffle support disk 36 which in the commercial unit is reinforced by radial alumina tubes filled with fibrous material (not shown). Design efforts should be aimed at protecting the fragile material of the shell and its top and bottom.

I claim:

1. A high temperature melting furnace comprising a fibrous refractory vertical cylindrical shell, a fibrous refractory circular furnace top resting on the upper end of the shell, a plurality of molybdenum disilicide resistance wire loops depending inside the shell from right-angle molybdenum disilicide terminals which extend radially through the shell and hold the loops spaced from the inside of the shell, means for mounting the terminals on the shell so as to prevent concentrations of the terminals' weight on the shell, the furnace top having a vertical access hole provided with a fibrous refractory closure plug which is upwardly removable to permit access to the inside of the shell when the furnace is operating, a fibrous refractory furnace bottom on which the shell rests and the furnace bottom having a vertical charging hole provided with a refractory pedestal removably insertable in the charging hole and adapted to support a crucible for upward insertion into the furnace, the upper end of the shell being formed with internal recessed upper and lower annular shelves respectively of larger and smaller diameters and a small fibrous refractory disk resting on the smaller diameter shelf and a larger fibrous refractory disk resting on the larger diameter shelf and on top of the small disk, both of the disks being radially split with their respective slits circumferentially offset from each other and the disks having holes registered with the top's access hole and through which the access closure plug extends, the furnace top resting on the larger disk and the disks supporting the weight of the furnace top, said shell furnace bottom and furnace top being free from rigid horizontal and vertical restraint to thermal expansion and contraction and said split larger and smaller disks being free from rigid connection with each other and the shell, the outside of the shell having access to the ambient air and said fibrous refractory comprising interlocked refractory ceramic fibers.

2. The furnace of claim 1 in which said shell bottom forms an internal recessed annular shoulder around said charging hole and an annular muffle support disk rests on said shoulder, said support disk forming a passage for said pedestal and the passasge having an internal annular support shoulder, an inverted cup-like refractory muffle removably resting on said support shoulder, said pedestal and its said pedestal top being insertable through said pedestal passage via said charging hole so as to carry a crucible on the pedestal top into said muffle.

3. The furnace of claim 2 in which a gas tube extends radially through said furnace bottom, said tube communicating with the inside of said muffle.

4. The furnace of claim 2 in which said muffle has a top forming an access hole and said furnace top has its access hole aligned therewith.

5. The furnace of claim 1 in which a horizontal support tray has a top on which said furnace rests via its said furnace bottom and the tray has a hole providing clearance for said charging hole and crucible pedestal, and an elevator is vertically movable below said tray and has a top on which said crucible pedestal is supported in alignment with said charging hole, said elevator being movable between a down position where said pedestal top is accessible below said furnace bottom for loading with a crucible containing a charge to be melted and an up position where the pedestal is inserted in said charging hole with the crucible inside said furnace space.

* * * * *